US005463267A

United States Patent [19]

Conway

[11] Patent Number: 5,463,267

[45] Date of Patent: Oct. 31, 1995

[54] SPARK PLUG WITH AUTOMATICALLY ADJUSTABLE GAP

[75] Inventor: Scott R. Conway, Lafayette, Ind.

[73] Assignee: Caterpillar Inc., Peoria, Ill.

[21] Appl. No.: 371,051

[22] Filed: Jan. 10, 1995

Related U.S. Application Data

[63] Continuation of Ser. No. 85,784, Jul. 6, 1993, abandoned.

[51] Int. Cl.[6] ..... H01T 13/26

[52] U.S. Cl. ..... 313/141; 313/125; 313/134; 313/142

[58] Field of Search ..... 313/125, 134, 313/137, 141, 146, 142; 123/169 EA, 169 EL, 169 EC, 145; 315/55, 57, 58; 98/29

[56] References Cited

U.S. PATENT DOCUMENTS

| | | | |
|---|---|---|---|
| 1,125,097 | 2/1913 | Hilliker et al. | 313/125 |
| 1,337,046 | 4/1920 | Coyle . | |
| 1,714,463 | 8/1928 | Holroyd | 123/169 |
| 1,930,003 | 3/1933 | Erny | 313/125 |
| 2,479,577 | 8/1949 | Lang . | |
| 3,158,775 | 4/1962 | Gelardi et al. | 313/125 |
| 3,612,931 | 10/1971 | Strumbos | 313/11.5 |
| 3,725,715 | 4/1973 | Krow | 313/131 |
| 3,743,877 | 7/1973 | Strumbos | 313/11.5 |
| 3,832,586 | 8/1974 | Podiak | 313/125 |
| 3,879,628 | 4/1975 | Felt | 313/141 |
| 3,882,341 | 5/1975 | Green | 313/134 |
| 3,951,144 | 4/1976 | Siegle | 123/148 |
| 4,059,782 | 11/1977 | Lentz | 315/58 |
| 4,193,012 | 3/1980 | Podiak et al. | 313/137 |
| 4,539,503 | 9/1985 | Esper | 313/11.5 |
| 4,944,280 | 7/1990 | Washington | 123/627 |

FOREIGN PATENT DOCUMENTS

| | | | |
|---|---|---|---|
| 514273 | 3/1921 | France | 123/169 |
| 193058 | 4/1906 | Germany | 123/169 |
| 8801076 | 5/1988 | Germany . | |
| 172069 | 12/1921 | United Kingdom | 313/125 |

*Primary Examiner*—Donald J. Yusko
*Assistant Examiner*—N. D. Patel
*Attorney, Agent, or Firm*—William C. Perry

[57] ABSTRACT

In spark ignited engine configurations, it is common to provide a spark plug that has a spark gap that has dimension that will accommodate good starting capabilities for the engine. In some cases, this spark gap is larger than required for the engine to run efficiently, especially at high loads. As a result, the voltage required to bridge the gap when the engine is running at high loads is much higher than necessary and causes erosion of the electrode and a build up of deposits on the ground strap. Ultimately, this greatly reduces the life of the spark plug. The present invention provides a spark plug that utilizes an adjusting means that is connected to the electrode of the spark plug and functions to move the electrode with respect to the ground strap to adjust the gap therebetween. The adjusting means is responsive to the temperature of the spark plug which will vary with engine loads or an increase in pressure within the combustion chamber.

16 Claims, 3 Drawing Sheets

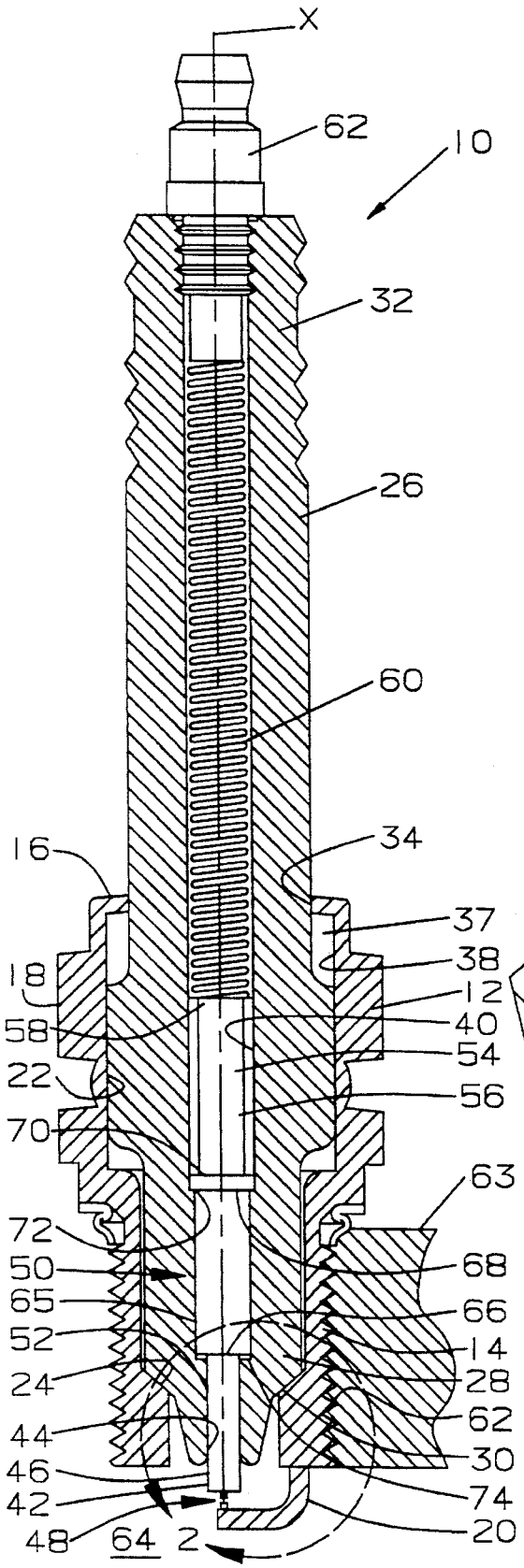
Fig_1_
Fig_2_
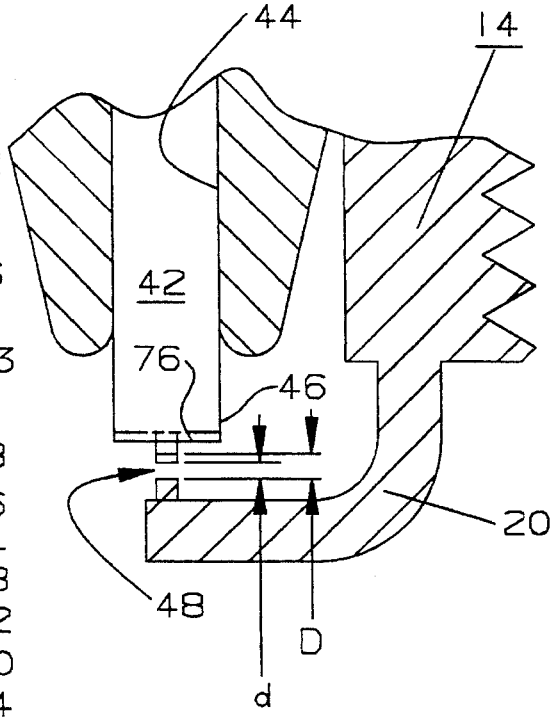

SPARK PLUG WITH AUTOMATICALLY ADJUSTABLE GAP

This is a file wrapper continuation of application Ser. No. 08/085,784, filed Jul. 6, 1993, now abandoned.

TECHNICAL FIELD

This invention relates generally to spark plug arrangements and more particularly to a spark plug arrangement that defines a gap that is adjusted automatically in response to engine operation.

BACKGROUND ART

It is commonly recognized in the operation of spark ignited engines that the size of the gap between the electrode of a spark plug and the adjacent ground strap is critical. It is also recognized that the size of the gap required to provide excellent starting and low idle characteristics is far different from the size of the gap required for excellent engine performance at high loads. It is therefore common practice to provide a spark gap that will provide acceptable operation under all conditions, but that is ideal to none. Primary consideration, however, is given to a gap size that will at least provide good starting characteristics.

The spark gap selected to provide good starting characteristics is much larger than is required to operate the engine under high load conditions. This requires a relatively high voltage to provide a spark that will travel across the gap under high engine loads. The high voltage tends to allow the spark to pull material away from the electrode as it jumps from the electrode only to deposit that material on the ground strap. This continual erosion of the electrode and buildup of material on the ground strap tends to shorten the life of the spark plug dramatically.

One known method of controlling the buildup of material on the tip of the plug is disclosed in U.S. Pat. No. 4,539,503, issued to Friedrich Esper et al. on Sep. 3, 1985. This patent discloses a spark plug that utilizes an electrode that is encapsulated in an insulator. The material of both the electrode and insulator is such that the operating temperature of the plug dictates the heat transfer between the two components. In doing so, the deposits on the insulator will be burned off while keeping the insulator below a temperature that would cause glow ignition. In combination with very specific materials of each component, they are designed such that a gap exists between the electrode and the insulator under low temperature operation. As the temperature increases the metal of the electrode will "flow" to fill the gap and alter the heat transfer therebetween. While there is some physical adjustment between the electrode and the ground strap, the effective gap that is exposed to the combustible mixture in the combustion chamber, remains the same because of the encapsulation of the electrode within the insulator. The distance between the insulator and the ground strap doesn't change and the operation of spark plug is unaltered.

Another spark plug design that utilizes an adjustable gap is disclosed in U.S. Pat. No. 3,612,931, issued on Oct. 12, 1971, and U.S. Pat. No. 3,743,877, issued on Jul. 3, 1973, both of which are issued to William P. Strumbos. These patents disclose the use of a heat shunt that has a thermal gap positioned between the shunt and the outer shell. The gap prevents heat transfer through the shunt at lower operating temperatures and the shunt will expand at higher operating temperatures to bridge the gap to provide improved cooling of the plug. The adjustment of the air gap is solely intended to alter the transmission of heat with respect to the plug and does not alter the characteristics of the spark between the electrode and the ground member.

The present invention is directed to overcoming one or more of the problems as set forth above.

DISCLOSURE OF THE INVENTION

In one aspect of the present invention, a spark plug assembly is disclosed that is adapted for use with an internal combustion engine. The spark plug has an external shell that defines a ground member and an insulator member that is secured within the outer shell. An electrode member is secured within the insulator member in a manner wherein a first end portion of the electrode extends from the insulator to a position that is adjacent the ground member to define a gap therebetween. A means for adjusting the dimension of the gap between the electrode and the ground member is provided that operates in response to the operation of the engine.

In another aspect of the present invention, a spark plug assembly is adapted for use with an internal combustion engine that includes an outer shell that has a centrally disposed bore and a ground member extending from one end thereof. An insulator member has a first and second end portion and a centrally disposed bore and is positioned within the outer shell. An electrode member having a first and second end portion is positioned within the central bore of the electrode in a manner wherein the first end portion of the electrode extends beyond the first end portion of the insulator to a position adjacent the ground member. A means for adjusting the position of the first end portion of the electrode with respect to the ground member is provided to operate in response to the operating temperature of the spark plug.

With a spark plug assembly as set forth above, a gap between the electrode and the ground member may be established that will provide excellent starting characteristics for an engine. Subsequently, as the temperature of the spark plug increases or as pressure in the combustion chamber is increased as a result of higher engine loads, the spark gap may be reduced to a dimension that is more conducive to operation in that mode. When the gap is reduced, lower voltage is required to produce a sufficient spark and therefor the life of the spark plug is significantly increased.

BRIEF DESCRIPTION OF THE DRAWINGS

FIG. 1 is a diagrammatical cross-sectional view of a spark plug that embodies the principles of the present invention;

FIG. 2 is an enlarged view of the area indicated at 2 in FIG. 1;

BEST MODE FOR CARRYING OUT THE INVENTION

Figure 3:
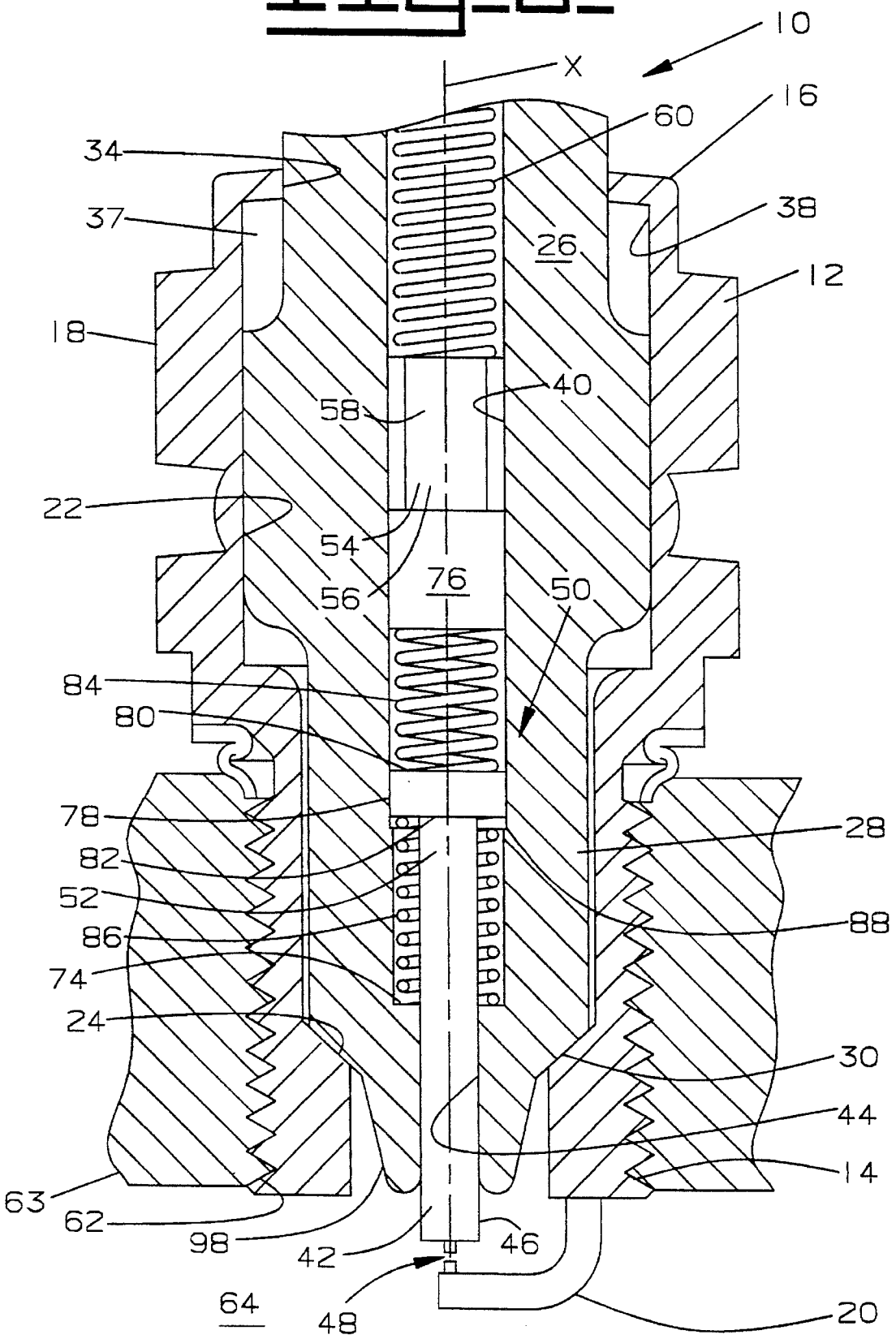
FIG. 3 is a diagrammatical cross-sectional view of an alternate embodiment of a spark plug.

Referring now to the drawings, and more particularly FIG. 1, it can be seen that a spark plug assembly 10 is shown that includes an outer shell 12. The outer shell 12 defines a first, threaded end portion 14 and a closing flange 16 on a second end portion 18. A ground member 20 in the form of a strap, extends from the first end portion 14 of the outer shell and terminates at a radially inward position that is generally in the region of a central axis X of the spark plug. A stepped bore 22 extends through the outer shell and defines an inwardly tapered shoulder 24 generally in the area of the first end portion thereof.

An insulator member 26 made of ceramics or other non-conductive material is positioned within the bore 22 formed in the outer shell 12. The insulator 26 has a first end portion 28 that defines an outwardly tapered shoulder 30 that abuts the tapered shoulder 24 formed by the outer shell 12. A second end portion 32 of the insulator extends through the second end portion 18 of the outer shell and extends through a bore 34 defined by the closing flange 16. A material shown at 37, such as talc, is packed in a void 38 created between the insulator and the closing flange to both seal the connection between the two components at the second end portion 18 of the outer shell and to create pressure between the mating tapered surfaces 24 and 30 to seal that connection as well. The insulator member defines a stepped bore 40 that extends the length of the insulator. An electrode 42 is positioned within a first portion 44 of the bore 40 and has a first end portion 46 that extends through the first end portion 26 of the insulator to a position that is adjacent the ground strap 20 to establish a spark gap 48 therebetween. An adjusting means 50, which will be described in detail hereinafter, is positioned for contact with a second end portion 52 of the electrode. A resistor 54 has a first end portion 56 positioned for contact with the adjusting means 50 and a second end portion 58 that is engaged with a spring 60. The spring 60 extends between the resistor and a connecting terminal 62 (FIG. 1) that is threadably engaged with the bore 40 of the insulator member 26 at the second end portion 32 thereof. The adjusting means 50, the resistor 54 and the spring 60 are positioned in contact with one another to transmit an electric charge between the terminal and the electrode to produce a spark that will arc across the gap 48 to the ground strap 20. It is to be understood that the spark plug is mounted in traditional fashion within a threaded bore 62 of an engine head 63. Such a mounting places the first end portion 14 of the outer shell 12 and first end portion 28 of the insulator 26 in communication with a combustion chamber 64 of each respective cylinder in an engine.

In one embodiment shown in FIG. 1, the adjusting means 50 includes a canister 65 filled with wax or other temperature reactive material that will change from a first to a second condition in response to the temperature of the spark plug 10, which is in turn controlled by the engine load. A first end portion 66 of the canister is attached to the second end portion 52 of the electrode member 42. A second end portion 68 of the canister defines an enlarged flange 70. The flange 70 is engageable with a radially extending shoulder 72 defined by the stepped bore 40 of the insulator 26 to limit the travel of the second end portion 68 of the canister. The first end portion 66 of the canister is permitted to move with respect to the second end portion 68 in response to the change between the first and second conditions of the material within the canister. This in turn, will establish a first end portion and a second position (shown in phantom lines in FIG. 2) of the electrode 42 with respect to the ground strap 20. When the temperature of the spark plug reaches or exceeds the preselected temperature, the first end portion 66 of the canister 65 is forced into contact with a radially extending end face 74 defined by the bore 40. In doing so, the first end portion 46 of the electrode 42 is repositioned with respect to the ground strap 20. As can be seen in FIG. 2, the distance between the first end portion 46 of the electrode 42 and the ground strap 20 is indicated at "D" when the electrode is in its first position. When the electrode is in its second position, the first end portion of the electrode is positioned from the ground strap a distance that is indicated at "d". In the preferred embodiment, "D" equals a dimension that falls within a range of 0.432 mm to 0.483 mm and "d" equals a dimension that falls within the range of 0.178 mm to 0.229 mm.

Turning now to FIG. 3, a second embodiment of the adjusting means 50 will now be described, it being understood that identical components in each of the embodiments will retain the same reference characters throughout the description. In this embodiment, the resistor 54 is positioned in contact with a stationary member or plug member 76 that is fixed within the bore 40 of the insulator 26. The second end portion 52 defines an enlarged head portion 78 that is positioned for movement within the bore 40. The enlarged head portion defines a first surface 80 and a second surface 82. A first spring member 84 is positioned within the bore 40 between the stationary member 76 and the first surface 80 of the enlarged head portion 78. The first spring member 84 is sufficient to exert a force of a preselected magnitude. A second spring member 86 is positioned in the bore 40 and extends between the end face 74 of the bore 40 and the second surface 82 of the enlarged head portion. The second spring member 86 is designed to exert a dual force against the enlarged head portion depending upon the temperature of the spark plug in the combustion chamber 64. When the spark plug is operating at point below a preselected temperature, a force of a first preselected magnitude is exerted by the second spring against the enlarged head portion. This force is greater than that of the first spring member 84 and the enlarged head portion is maintained in a first position within the respect to the bore 40. With the enlarged head portion in this position, the electrode 42 is maintained in a first position with respect to the ground strap 20. The spacing between the electrode and the ground member in this first position is indicated at "D" in FIG. 2. When the preselected temperature is exceeded, the force of the second spring is reduced to a second preselected force that is below that of the first spring member 84. As a result, the enlarged head portion 78, and thus the electrode 42, are moved toward the ground strap 20. The electrode is allowed to move toward the ground strap until the enlarged head portion 78 contacts a motion limiting shoulder 88 defined by the bore 40. When the enlarged head portion is in contact with the shoulder 88, a second position for the electrode is established with respect to the ground strap. In this second position, the electrode is spaced from the ground strap a distance that is indicated at "d" in FIG. 2.

Figure 4:
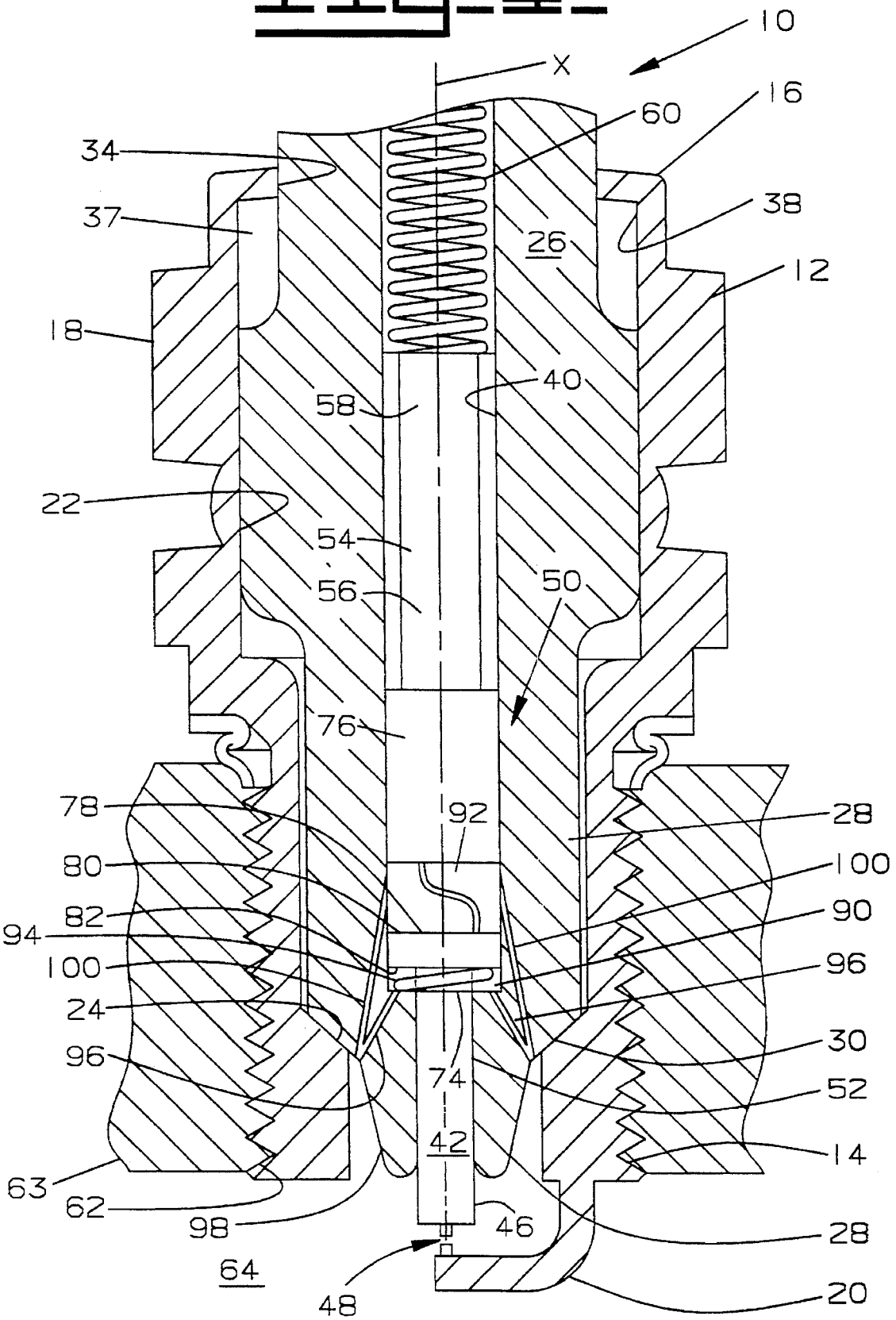
FIG. 4 is a diagrammatical cross-sectional view of yet another alternate embodiment of a spark plug.

Turning now to FIG. 4, a third embodiment of the adjusting means 50 will be described. As in the second embodiment, a stationary member or plug 76 is positioned at a predetermined location within the bore 40 of the insulator. Also, the enlarged head portion 78 of the electrode member 42 is positioned within the bore 40 for movement between the plug member 76 and the end face 74 of the bore 40. The enlarged head portion 78 divides the space created between the stationary member 76 and the end face 74 of the bore into a first chamber 90 and a second chamber 92.

The first chamber 90 is defined between the end face 74 and the second surface 82 of the enlarged head portion 78 while the second chamber 92 is defined between the first surface 80 of the enlarged head portion 78 and the stationary member 76. A spring 94 is positioned in the first chamber 90 to extend between the end face 74 and the second surface 82 of the enlarged head portion. A plurality of first passageways 96 extend between the first chamber 90 and an outer periphery 98 of the first end portion 28 of the insulator 26. A second plurality of passageways 100 extend between the second chamber 92 and the outer periphery 98 of the first end portion 28 of the insulator to intersect with the first passageways 96. Being so arranged, the passageways 96 and 100 are sufficient for communicating the pressure in the region of the first end portion 28 of the insulator member 26 equally to the respective first and second chambers 90 and 92. Since the area of the first surface 80 is substantially larger than that of the second surface 82, due to the connection of the electrode 42 with the surface 82, a force differential is created between the two chambers. As a result, the enlarged head portion will be moved toward the end face 74 of the bore 40 when the pressure in the second chamber 92 exceeds the bias of the spring member 94 and the pressure in the first chamber 90. This movement, of course, results in the movement of the electrode 42 to its second position, closer to the ground strap. The respective dimensions of the first and second positions of the electrode are represented by reference characters "D" and "d" in FIG. 2.

INDUSTRIAL APPLICABILITY

As previously set forth, the spark plug assembly 10 is mounted within an engine head 63 in a manner to place each spark plug assembly 10 in communication with the combustion chamber 64 of an engine. Being so mounted, at least the first end portions 28 and 14 of the insulator member 26 and the ground member 20 respectively, are subjected to the variable temperatures, engine loading, and combustion pressures that are associated with the operation of the engine. Accordingly the spark plug assembly 10 is provided with a means by which the electrode 42 is adjustable is response to each of the above mentioned variables.

In the embodiment shown in FIG. 1, the electrode 42 is positioned in its first position with respect to the ground strap 20 when the engine has not been started or is running at a low load condition. As the engine is started and the temperature rises, the wax, or other temperature reactive material housed within the canister 65, will undergo a phase change when the temperature reaches a preselected point. When this phase change occurs, the wax will cause the first end portion 66 of the canister 65 to expand away from the second end portion 68, forcing the electrode 42 outwardly toward the ground strap 20. When the first end portion 66 of the canister 65 abuts the end face 74 of the bore 40, movement of the electrode is stopped and a second operating position is established.

In the second embodiment shown in FIG. 3, the electrode 42 is held in its first position by the balance achieved between the opposing forces of the first and second spring members 84 and 86. The second spring member 86 has a first preselected force that is established when the engine is cold or is running at low load conditions. As the temperature is increased in response to engine loads, the force of the spring 86 becomes reduced. The change in force is due to the material from which the spring is made. Any one of several bi-metal materials is known to be sufficient and whose change is spring force is predictable. As the force of the second spring 86 is reduced to a magnitude that is lower than that of the first spring, the enlarged head portion 78 is moved toward the first end portion 28 of the insulator 26. The movement of the enlarged head portion is stopped when it is brought into contact with the shoulder 88 formed by the bore 40. Abutment between the enlarged head portion with the shoulder establishes a second position of the electrode 42 with respect to the ground strap 20.

With reference to FIG. 4, it can be seen that the electrode 42 is moved between its first and second positions in response to pressure within the combustion chambers 64 of each respective cylinder. The first end portion 28 of the insulator 26 is positioned within the respective combustion chamber 64 in a manner wherein the passageways 96 and 100 communicate the pressure that exists in the combustion chamber to the respective first and second chambers 90 and 92. When the engine is initially started or is operating at low load, the force of spring 94 in the first chamber 90 is sufficient to maintain the electrode in its first position. As the pressure in the combustion chamber increases with the engine load, the pressure within the respective first and second chambers 90 and 92 is also increased. Since the area of the first surface 80 of the enlarged head portion 78 is larger than the area of the opposing second surface 82, a force differential is created. The force differential will cause the electrode 42 to be moved toward the ground strap 20 until the enlarged head portion 78 bottoms out on the spring 94 to stop further movement. At this point the electrode will have achieved its second position with respect to the ground strap.

With a spark plug assembly as set forth above, a spark gap 48 between the electrode 42 and the ground strap 20 is provided that has a relatively large dimension. This relatively large size is very desirable when starting a cold engine or when the engine is running at low load conditions. Alternatively, as the engine load is increased, the adjustment means 50 provides the capability of reducing the size of the spark gap 48 to a dimension that is more suitable for high load operation. Since the engine is normally running in a high load condition for the majority of the time, the voltage required to provide a sufficient spark to sustain this mode of operation is greatly reduced. The reduced voltage in turn, greatly reduces the amount of erosion to which the electrode is subjected and ultimately provides a drastic improvement in the life of the spark plug.

Other aspects, objects and advantages of this invention can be obtained from a study of the drawings, the disclosure and the appended claims.

I claim:

1. A spark plug assembly adapted for use with an internal combustion engine, comprising:

an outer shell defining a ground member;

an insulator member secured within the outer shell;

an electrode member secured within the insulator member in a manner wherein a first end portion of the electrode extends from the insulator to a position that is adjacent the ground member to define a gap therebetween; and means for adjusting the dimension of the gap between the electrode and the ground member, said adjusting means being adapted to move the electrode in a linear direction with respect to the insulator toward and away from the ground member in response to the operation of the engine.

2. A spark plug assembly as set forth in claim 1 wherein the adjusting means is responsive to an increase in temperature due to engine operation.

3. A spark plug assembly as set forth in claim 2 wherein the adjusting means further includes:

a canister member having a first and second end portion, said first end portion being connected to the second end portion of the electrode, said canister member being positioned within the insulator member and being sufficient to function in a first condition wherein the first and second end portions are maintained at a fixed distance therebetween when the spark plug is operating at a temperature below a preselected temperature, and a second condition wherein the first end portion is permitted to expand with respect to the second end portion when the temperature of spark plug exceeds said preselected temperature, to move the first end portion of the electrode closer to the ground member to reduce the gap therebetween.

4. A spark plug assembly as set forth in claim 1 wherein the adjusting means further includes:

an enlarged head portion having a first and second surface defined on opposing sides thereof, said enlarged head portion being connected to a second end of the electrode and positioned for movement within a bore extending through the insulator member;

a stationary member positioned within the bore of the insulator member;

a first spring having a preselected spring force and being positioned within the bore defined by the insulator member to extend between a stationary member and the first surface of the enlarged head portion of the electrode; and a second spring having a dual spring force and being positioned within the bore defined by the insulator member to extend between an end face of the bore and the second surface of the enlarged head portion of the electrode, wherein a first preselected spring force is sufficient to maintain the electrode in a first position with respect to the ground member when the spark plug is operating at a temperature below a preselected temperature, and a second preselected spring force, less than that of the first spring member, allows the electrode to move to a second position with respect to the ground member when the spark plug is operating at a temperature above said preselected temperature.

5. The spark plug assembly as set forth in claim 4 wherein a motion limiter is defined in the bore of the insulator member to contact the enlarged head portion defined on the electrode to establish the second position of the electrode.

6. The spark plug assembly as set forth in claim 1 wherein the adjusting means further includes:

an insulator member having a centrally disposed bore and being positioned within the engine in a manner wherein a first end portion thereof is in communication with a combustion chamber defined by said engine;

an electrode member having an enlarged head portion defined on a second end portion thereof, and being positioned within the bore in a manner to divide the bore into a first chamber and a second chamber, said enlarged head portion defining a first surface that is positioned to face the second chamber and a second surface that is smaller than the first surface and is positioned to face the first chamber, said electrode member being positioned for movement within said bore between a first position wherein the gap between the first end portion of the electrode and the ground member is a first preselected distance and second position wherein said gap is a second preselected distance;

means for biasing the electrode member toward said first preselected position, said biasing means being positioned within said first chamber; and means for communicating pressure from the combustion chamber to each of the first and second chambers in a manner to create a force in the second chamber that is greater than the combined force of the biasing means and the pressure in the first chamber to move the electrode member to its second position when the combustion pressure exceeds a preselected level as a result of engine operation.

7. The spark plug assembly as set forth in claim 6 wherein the biasing means includes a spring member positioned in said first chamber to extend between the enlarged head portion and an end face of the bore defined by insulator member.

8. The spark plug assembly as set forth in claim 6 wherein the means for communicating includes a plurality of passageways defined in the first end portion of said insulator member to extend between each of the respective first and second chambers defined by the insulator member and an outer periphery thereof to communicate variable operating pressure from within the combustion chamber to each of the respective first and second chambers defined by the insulator member.

9. The spark plug assembly as set forth in claim 6 wherein the enlarged head portion defines a first surface that faces the second chamber and a second surface that faces the first chamber, said second surface being smaller than said first surface to create a differential in effective surface area between the first and second chambers that will allow the force in the second chamber override the force of the spring member and the pressure in the first chamber to move the electrode to its second position when the engine operation exceeds a preselected level of operation.

10. A spark plug assembly adapted for use with an internal combustion engine, comprising:

an outer shell having a centrally disposed bore and a ground member extending from one end thereof;

an insulator member having a first and second end portion and a centrally disposed bore and being positioned within said outer shell;

an electrode member having a first end portion and a second end portion and being positioned within the central bore of the insulator member in a manner wherein the first end portion of the electrode extends beyond the first end portion of the insulator to a position adjacent said ground member; and means for adjusting the position of the first end portion of the electrode in a linear direction with respect to the insulator to move the first end portion of the electrode toward and away from the ground member in response to the operating temperature of the spark plug assembly.

11. The spark plug assembly as set forth in claim 10 wherein the adjusting means further includes:

a canister member having a first end portion connected to the second end portion of the electrode and a second end portion, said canister member being positioned within the bore of the insulator member in a manner in which the position of the second end portion of the canister member is fixed with respect to the insulator member and the first end portion is permitted to move with respect thereto;

a temperature reactive material housed within said canister member, said material being sufficient for operating in a first condition wherein the respective positions of the first and second end portions of the canister member are maintained when the spark plug assembly is operating at a temperature that is below that of a preselected temperature and a second condition wherein the distance between the first and second end portions is increased when the spark plug assembly is operating at a temperature that is above that of a preselected temperature.

12. A spark plug assembly as set forth in claim 11 wherein said temperature reactive material is wax that is maintained in a solid condition below said preselected temperature and experiences a phase change to a liquid condition at a temperature above said preselected temperature.

13. A spark plug assembly as set forth in claim 11 wherein the second end portion of the canister member defines an enlarged flange member that is positioned to engage a shoulder portion formed within the centrally disposed bore of the insulator member.

14. A spark plug assembly as set forth in claim 10 wherein the adjusting means further includes:

an enlarged head portion having first and second surfaces defined on opposite sides thereof and being connected to the second end portion of the electrode member;

a stationary member fixedly disposed within the bore defined in the insulator member;

a first spring member having a force of a preselected magnitude and being positioned between the first surface of the enlarged head portion and the stationary member;

a second spring member that is positioned between an end face of the bore defined by the insulator member and the second surface of the enlarged head portion, said second spring member being sufficient for exerting a force of a first preselected magnitude when the operating temperature of the spark plug assembly is below a preselected temperature to maintain the electrode in a first position with respect to the ground member, and a force of a second preselected magnitude when the operating temperature of the spark plug assembly is above the preselected temperature, said force of the second preselected magnitude being less than that of the first spring member to to allow the electrode to be moved toward a second position with respect to the ground member.

15. The spark plug assembly as set forth in claim 14 wherein the gap between the electrode and the ground member falls within a range of 0.432 mm to 0.483 mm when the electrode is in its first position, and range of 0.178 mm to 0.229 mm when the electrode is in its second position.

16. A spark plug assembly adapted for use with an internal combustion engine, comprising:

an outer shell having a centrally disposed bore and a ground member extending from one end thereof;

an insulator member having a first and second end portion and a centrally disposed bore and being positioned within said outer shell;

an electrode member having a first end portion and a second end portion and being positioned within the central bore of the insulator member in a manner wherein the first end portion of the electrode extends beyond the first end portion of the insulator to a position adjacent said ground member; and means for adjusting the dimension of the gap between the electrode and the ground member, said adjusting means being operable in response to an increase in pressure due to engine operation.

* * * * *